US010335929B2

(12) United States Patent
Chou et al.

(10) Patent No.: US 10,335,929 B2
(45) Date of Patent: Jul. 2, 2019

(54) TOOL WITH A RATCHET MECHANISM

(71) Applicant: STANLEY CHIRO INTERNATIONAL LTD., Taichung Hsien (TW)

(72) Inventors: Henry Chou, Taichung (TW); Yi Tung Chan, Taichung (TW)

(73) Assignee: Stanley Chiro International Ltd., Taichung Hsien (TW)

( * ) Notice: Subject to any disclaimer, the term of this patent is extended or adjusted under 35 U.S.C. 154(b) by 151 days.

(21) Appl. No.: 15/663,224

(22) Filed: Jul. 28, 2017

(65) Prior Publication Data

US 2018/0117742 A1 May 3, 2018

(51) Int. Cl.

| | |
|---|---|
| ***B25B 13/46*** | (2006.01) |
| ***B25B 13/04*** | (2006.01) |
| *B25B 13/00* | (2006.01) |

(52) U.S. Cl.

CPC ..... *B25B 13/463* (2013.01); *B25B 13/04* (2013.01); *B25B 13/465* (2013.01); *B25B 13/00* (2013.01); *B25B 13/468* (2013.01)

(58) Field of Classification Search

CPC combination set(s) only.
See application file for complete search history.

(56) References Cited

U.S. PATENT DOCUMENTS

| | | | | |
|---|---|---|---|---|
| 9,545,705 | B2 * | 1/2017 | Hu | B25B 13/463 |
| 9,573,253 | B1 * | 2/2017 | Chen | B25B 13/005 |
| 9,744,652 | B2 * | 8/2017 | Liao | B25B 13/463 |
| 9,782,873 | B2 * | 10/2017 | Chi | B25B 13/463 |
| 9,821,441 | B2 * | 11/2017 | Chen | B25B 13/463 |
| 2016/0375561 | A1 * | 12/2016 | Chen | B25B 13/463 81/63.2 |

* cited by examiner

*Primary Examiner* — David B. Thomas
(74) *Attorney, Agent, or Firm* — Caeden Drayton; Adan Ayala

(57) ABSTRACT

A hand tool or wrench with a ratcheting mechanism. The wrench includes a number of components such as an abutting block and a pawl for use in a bistable ratchet operation. The wrench includes a ratchet mechanism that provides stable seating of the components, so that the mechanism is securely retained in a driving mode, as well as enabling a user to select a driving mechanism with ease so as to improve work efficiency.

18 Claims, 10 Drawing Sheets

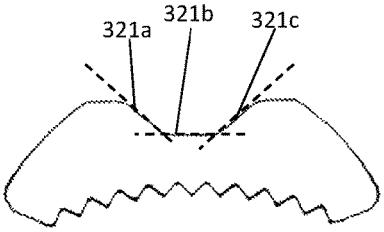
Fig. 12A
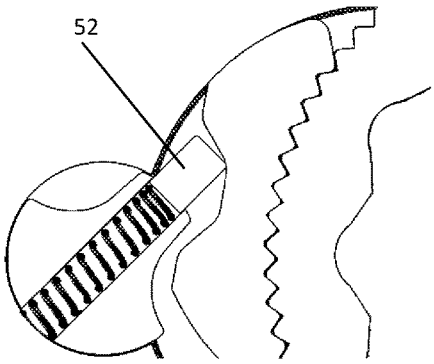
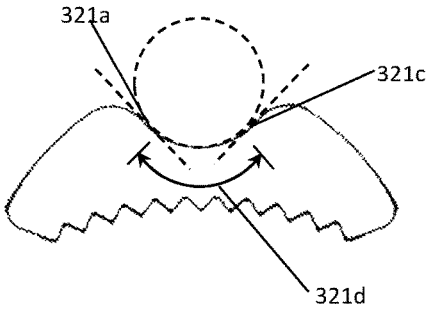
Fig. 12B
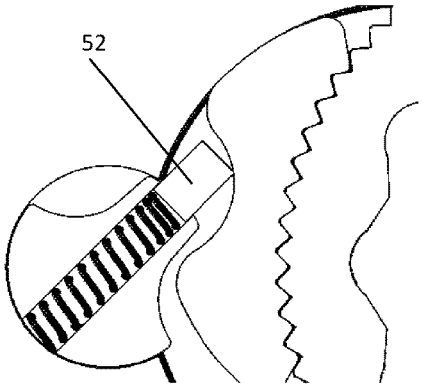
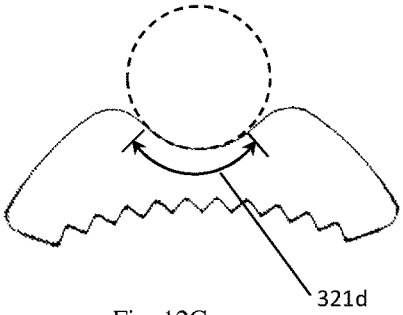
Fig. 12C
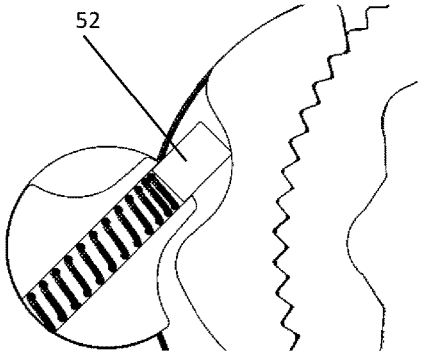

TOOL WITH A RATCHET MECHANISM

This patent application claims priority to TW application No. 105123822 filed 28 Jul. 2016 which is hereby incorporated by reference in its entirety.

FIELD OF THE INVENTION

The present invention relates to hand tools, and more particularly to a ratchet mechanism, for example for use in wrenches, screwdrivers, and the like.

BACKGROUND TO THE INVENTION

Rotational ratchet mechanisms are known. Common designs allow users to select a driving direction in which a torque may be transferred from, for example, a handle of the device to a driving member. Wrenches, screwdrivers and other tools may include a ratchet mechanism which allows a user to select a rotational direction in which torque can be applied to a screw, nut, bolt, etc. by rotating the handle in the corresponding direction. When the handle is rotated in the opposite direction, the mechanism operates as a ratchet, and does not transfer torque to the screw, nut, bolt etc.

Typically, either rotational direction is selectable. Consequently, the item to be driven by the screwdriver, wrench, etc. (e.g. screw, nut, bolt) may be rapidly tightened or loosened by selecting the appropriate direction for the ratchet mechanism. Once this is done, the handle can be rotated back and forth in both rotation directions. When rotated in the desired direction, torque is transferred to the driven object and it is tightened or loosened as desired. When rotated in the opposite direction, the mechanism ratchets and does not undo the tightening or loosening of the previous twist in the desired direction. Such mechanisms are of great benefit as they save users from fatigue and also help speed up tightening or loosening of fixings as the user does not have to waste time adjusting their grip on the handle in order to rotate the fixing through multiple complete revolutions.

The manner in which the user selects a direction is susceptible to both jamming and not being retained in the correct position to apply torque in the desired direction. If the mechanism slips out of position in this way, time may be wasted while the device is adjusted, Notwithstanding the usefulness of the above-described apparatuses, a need still exists for an uncomplicated, easily utilized tool with a ratcheting mechanism.

SUMMARY OF THE INVENTION

The present disclosure describes a ratchet mechanism that provides a more stable seating of the components, so that the mechanism is securely retained in a driving mode, as well as enabling a user to select a driving mechanism with ease so as to improve work efficiency.

To achieve this object, the present invention provides a bistable ratchet mechanism, comprising: a body having a first chamber, a second chamber adjacent to the first chamber and a third chamber connecting the first and second chambers to one another; a driving member, being rotatably retained in the first chamber, and having a first pawl portion arranged around an external portion of the driving member; a stopping member, provided in the third chamber and having a second pawl portion arranged on a first face, and arranged so that the second pawl portion engages with the first pawl portion; a switching member, rotatably provided in the second chamber and comprising a rotating member, the rotating member being radially provided with a dial member for manipulating the rotating member, the rotating member being further radially provided with a hole; and an elastic abutting assembly, comprising an elastic member and an abutting block, the elastic member in contact with a first end of the abutting block, the first end of the abutting block and the elastic member being received in the hole, and the elastic member biasing the abutting block toward a recess in a second face of the stopping member, opposite the second pawl portion, to bias the stopping member into contact with the driving member; wherein the mechanism is configurable in a position of unstable equilibrium, a first position of stable equilibrium or a second position of equilibrium, and is configured to transition between the stable and unstable equilibrium positions via non-equilibrium positions by rotating the switching member; wherein: the position of unstable equilibrium corresponds to a neutral position in which the driving member is rotatable in either a first direction or a second direction relative to the body; in the first stable equilibrium position the stopping member contacts a first internal wall of the body and prevents the driving member from rotating in the first direction relative to the body; and in the second stable equilibrium position the stopping member contacts a second internal wall of the body and prevents the driving member from rotating in the second direction relative to the body, the second direction being opposite to the first direction; and wherein positions between the stable and unstable equilibria are non-equilibrium positions because a force biasing the abutting block is incompletely cancelled by the reaction force acting on the abutting block from the stopping member, the resultant force further biasing the stopping member towards an internal wall of the body. This arrangement of stable and unstable equilibria allows the mechanism to flip to a stable position for applying rotational force (torque) to an object to be rotated when only small offsets are applied to the mechanism. In particular, it is easy and quick for a user to select a direction in which to apply torque using only a minor movement, which causes the mechanism to settle fully into a stable, driving position.

As used herein with reference to the switching member, "radially provided" means in a direction radially outwardly from the rotational axis of the switching member. For example, when it is in the second chamber, the switching member is configured to rotate about a particular axis. The hole is provided in a generally radial direction to this axis. Similarly, the dial member extends in a generally radial direction from this axis. That is to say, the switching member defines a hole through the switching member.

In the neutral position, the driving member is rotatable in either of a first or a second direction which are opposite to one another. This means that there is a single rotational axis (relative to the body) around which the driving member can rotate (also relative to the body) when it is in the neutral position. The two available rotations correspond to rotating about this axis in a first direction (e.g. clockwise when the rotational axis is viewed from a particular direction) and rotating about this axis in a second direction (e.g. anticlockwise when the rotational axis is viewed from the same direction). Note that the use of "either" and "or" in this context is not intended to mean that only one direction of rotation is possible. Instead it means that starting from the neutral position; the user can rotate the driving member in a single direction at any one time. As explained below, small rotations can cause the mechanism to leave the neutral position, and enter a non-equilibrium arrangement. Consequently, in some cases a user may only be able to rotate the driving member in one direction before the mechanism is no longer in the neutral position. However, prior to this actually occurring, the mechanism remains in the neutral position, and it will be possible to turn the driving member in either of the two directions, at least initially.

Where the driving member is further biased towards an internal wall of the body, this is equivalent to the statement that the driving member is driven towards a position of stable equilibrium, as will be clear from the following description.

Additionally, the present disclosure describes an abutting block for use as an abutting member in ratchet mechanisms, such as that described above. The abutting block comprises: a generally cuboidal body having length, width and height and comprising a first face for engaging with a stopping member, and a second face opposite the first face for engaging with an elastic member, wherein the first and second faces are separated from one another by the length of the body; wherein the first face has a pair of straight edges extending along the height direction for engaging the stopping member. The use of straight edges for contacting the stopping member provides the unbalanced reaction forces set out above in relation to the non-equilibrium positions.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the root terms "include" and/or "have", when used in this specification, specify the presence of stated features, steps, operations, elements, and/or components, but do not preclude the presence or addition of at least one other feature, step, operation, element, component, and/or groups thereof.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus.

For definitional purposes and as used herein "connected" "coupled" or "attached" includes physical, whether direct or indirect, affixed or adjustably mounted. Thus, unless specified, "connected" "coupled" or "attached" is intended to embrace any operationally functional connection.

As used herein "substantially," "generally," "slightly" and other words of degree are relative modifiers intended to indicate permissible variation from the characteristic so modified. It is not intended to be limited to the absolute value or characteristic which it modifies but rather possessing more of the physical or functional characteristic than its opposite, and preferably, approaching or approximating such a physical or functional characteristic.

In the following description, reference is made to accompanying drawings which are provided for illustration purposes as representative of specific exemplary embodiments in which the invention may be practiced. Given the following description of the specification and drawings, the apparatus and methods should become evident to a person of ordinary skill in the art. Further areas of applicability of the present teachings will become apparent from the description provided herein. It is to be understood that other embodiments can be utilized and that structural changes based on presently known structural and/or functional equivalents can be made without departing from the scope of the invention.

BRIEF DESCRIPTION OF THE DRAWINGS

Embodiments of the present invention shall now be described with reference to the accompanying drawings of which:

FIGS. 12A to 12C show examples of the shape of the recess in the stopping member.

Similar reference characters denote corresponding features consistently throughout the attached drawings.

DETAILED DESCRIPTION

Figures 1, 2:
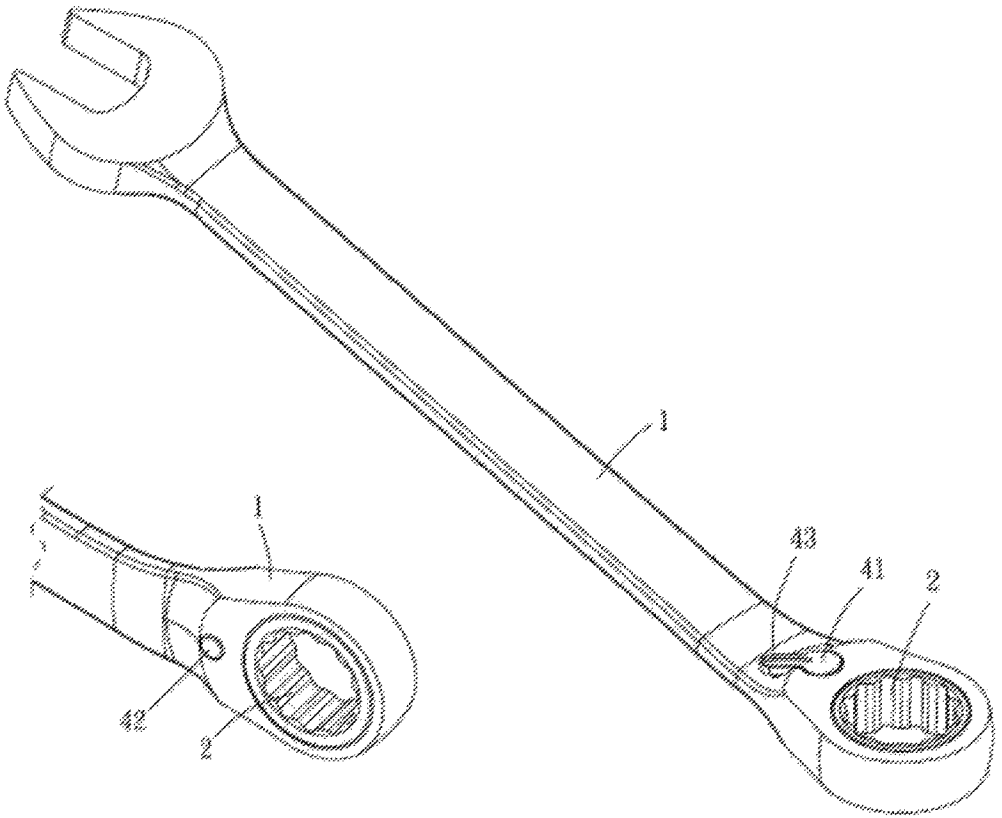
FIG. 1 is a perspective view of an embodiment of the present invention.
FIG. 2 is a partial perspective view of an embodiment of the present invention.
Figure 4:
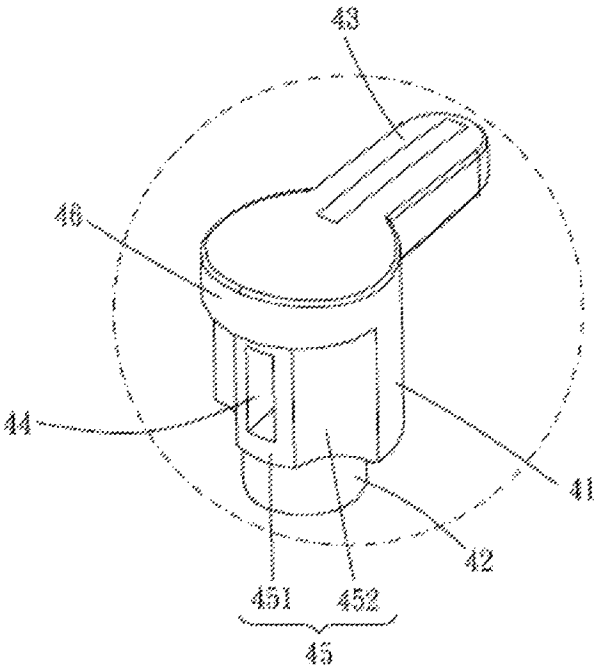
FIG. 4 is a partial enlarged view of an embodiment of the present invention.

The following is a description of the possible embodiments of the present invention by way of example only, and is not intended to limit the scope of the present invention.

Please refer to FIGS. 1 to 6, which depict one embodiment of the present invention. The ratchet wrench of the present invention comprises a body 1, a driving member 2, a stopping member 3, a switching member 4, and an elastic abutting assembly 5.

The body 1 is provided with a first chamber 11, a second chamber 12 adjacent to the first chamber 11, and a third chamber 13 that communicates with the first chamber 11 and the second chamber 12, one of the two ends of the second chamber 12 forming a large diameter section 121, and the other end forming a small diameter section 122.

The driving member 2 is rotatably provided in the first chamber 11 and is provided with a first pawl portion 21 along the outer peripheral surface. In the present embodiment, the first pawl portion 21 may have, for example, a plurality of external teeth, and the inner peripheral surface of the driving member 2 includes an actuating portion for driving a lock member (not shown). In the present embodiment, the actuating portion may be a through-hole having a polygonal shape. In other possible embodiments, the actuating portion may also be a convex portion having a polygonal shape, and may facilitate, for example, the assembly of such parts as a nut or a sleeve or the like.

The stopping member 3 is provided in the third chamber 13 and is provided with a second pawl portion 31 engaged with the first pawl portion 21. The second pawl portion 31 limits the direction of rotation of the driving member 2. In the present embodiment, the second pawl portion 31 has a shape corresponding to the first pawl portion 21 and may have, for example, a plurality of external teeth.

The switching member 4 is rotatably provided in the second chamber 12, and includes a rotating member 41 and a protrusion 42 extending from the rotating member 41, the rotating member 41 being accommodated in the large diameter section 121, and the protrusion 42 being accommodated in the small diameter section 122. The rotating member 41 is radially provided with a dial member 43 for manipulation at the end remote from the protrusion 42. The rotating member 41 is provided with a hole 44 in the radial direction, and when the rotating member 41 is rotated, the rotating member 41 can rotate smoothly around the protrusion 42 as an axis. Preferably, a first step 61 is formed between the large diameter section 121 and the small diameter section 122, and a second step 62 is formed between the rotating member 41 and the protrusion 42, the first step 61 and the second step 62 abutting against each other to stably position the rotating member 41 at the large diameter 121.

As described above, the rotating member 41 has a protrusion 42 extending from it. As shown in the Figures, the protrusion 42 is integrally formed with the rotating member 41, along with the dial member 43 to form the switching member 4. This means that rotating the dial member also causes the rotating member 41 and protrusion 42 to rotate. As set out above, this in turn causes the abutting block 52 to rotate as well, adjusting the mechanism in general. In particular, rotating the protrusion 42 allows a user to select a driving direction for the ratchet. Where the switching member 4 is rotatably provided in the second chamber 12, this is equivalent to saying that the switching member 4 is positioned in the second chamber 12, such that it is rotatable within the second chamber 12.

The elastic abutting assembly 5 comprises an elastic member 51 and an abutting block 52, the abutting block 52 comprising a first end 523 and a second end 524, the first end 523 comprising two stop arms 522 which extend from the second end 524. The elastic member 51 is located between the two stop arms 522 and forms gaps 525 with both stop arms 522. The first end 523 and the elastic member 51 are accommodated within the hole 44. In the present embodiment, the hole 44 is formed as a rectangular hole, and the radial dimension of the elastic member 51 is approximately the width of the hole 44. The elastic member 51 is elastically urged between the second end 524 of the abutting block 52 and the switching member 4 so that the second end 524 of the abutting block 52 normally abuts the stopping member 3 against the first pawl portion 21.

In the Figures, the elastic member 51 is shown as a spring, and more specifically as a compression spring. Consequently, where the elastic member 51 is elastically urged between the second end 524 of the abutting block 52 and the switching member 4, this means that the spring 51 is held in compression such that it exerts a force on both the abutting block 52 and the switching member 4. This force urges the abutting block 52 away from the switching member 4, causing the abutting block 52 to slide within the hole 44, to the extent that it is able, since it retains contact with the stopping member 3. The abutting block is described in more detail below.

Figure 8:
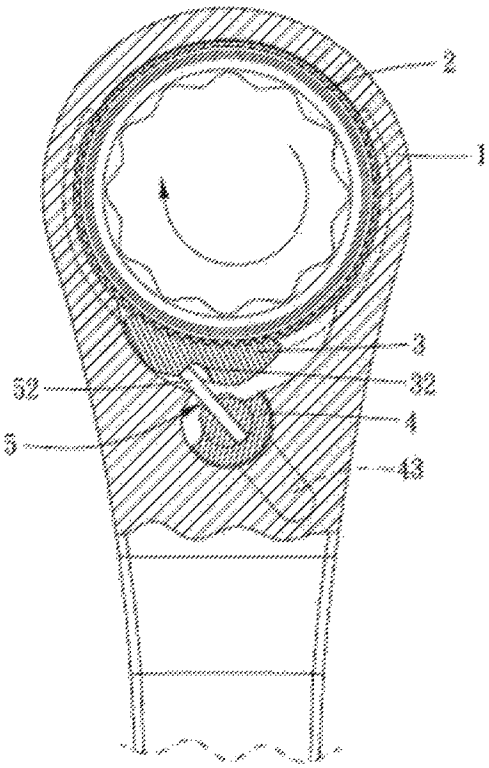
FIG. 7 and FIG. 8 are schematic views of the operation of an embodiment of the present invention.
Figure 7:
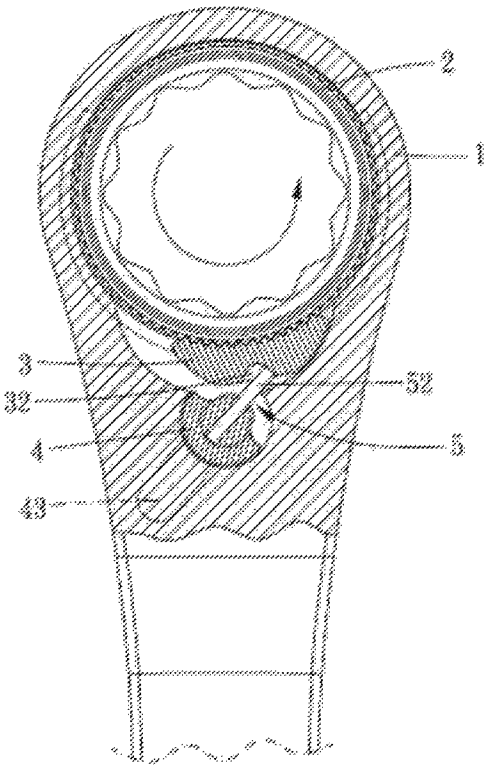

Wherein, the position at which the stopping member 3 is engaged with the first pawl portion 21 is adjusted by adjusting the switching member 4 so as to switch the direction of rotation of the driving member 2. As shown in FIGS. 7 to 8, when the switching member 4 is switched to a first position (as shown in FIG. 7) in this embodiment, the stopping member 3 is abutted by the abutting block 52 and stops the driving member 2 in, for example, a first direction, so that the driving member 2 is rotatable only in this first direction (as indicated by the arrow direction); when the switching member 4 is switched to a second position (as shown in FIG. 8), the stopping member 3 is abutted by the abutting block 52 and stops the driving member 2 in, for example, a second direction, so that the driving member 2 is rotatable only in this second direction (as indicated by the arrow direction).

It is to be noted that in the present embodiment, the abutting block 52 is U-shaped, and the thickness of the abutting block 52 can be made more uniform in the fabrication process. Since the elastic member 51 is located between the two stop arms 522 and forms gaps 525 with both stop arms 522, the elastic member 51 does not come into contact with the stop arms 522 during elastic extension and contraction, such that the elastic member 51 can be smoothly extended and retracted to prevent buckling of the elastic member 51 during extension and contraction attenuating the elastic force of the elastic member 51. Further, since the elastic member 51 is not brought into contact with the two stop arms 522, the outer diameter of the elastic member 51 may be slightly increased to provide a more stable spring force to urge against the abutting block 52 and enable better engagement between the first pawl portion 21 and the second pawl portion 31, avoiding damage resulting from reverse rotation of the switching member 4.

The stopping member 3 is further provided with an indentation or recess 32 at the end remote from the second pawl portion 31, and a second end 524 of the abutting block 52 abuts against the wall of the indentation or recess 32, thereby effectively preventing the abutting block 52 from coming off the stopping member 3. Put another way, the stopping member 3 defines a recess 32 at the end distal to the second pawl portion 31.

It is to be noted that the rotating member 41 is provided with a notch 45 in the radial direction of the stopping member 3, and the rotating member 41 has a flange 46 formed on the opposite side of the notch 45. The notch 45 comprises a convex portion 451 and an arcuate segment 452 located on both sides of the convex portion 451, wherein, as viewed in the axial direction of the rotating member 41, the radial dimension of the flange 46 is greater than the radial dimension of the convex portion 451, and the hole 44 is provided on the convex portion 451. When the switching member 4 is rotated, the flange 46 forms an upper support portion, and the protrusion 42 forms a lower support portion, which respectively support the upper and lower ends of the switching member 4 so as to combat the upward and downward rotational force generated during manipulation of the switching member 4 and render rotation of the switching member 4 smoother, as well as preventing the switching member 4 from jumping out of the second chamber 12.

In other words, the rotating member 41 further defines a notch 45, comprising a convex portion 451 and two arcuate segments 452 on either side of the convex portion, in the stopping member. The hole 44 is formed through the convex portion 451. The notch 45 has a flange 46, to which the dial member is joined. Flange 46 and protrusion 42 function as upper and lower support portions respectively to prevent unwanted axial movement of the switching member 4. As discussed above, this supportive arrangement is provided when the switching member 4 is rotated. By this it is meant that during rotation the flange 46 and protrusion 42 provide support so that no axial movement of the switching member 4 occurs. However, as is clear from the figures, when the switching member 4 is not rotating, the flange 46 and protrusion 42 also provide support to prevent axial movement of the switching member 4.

Figure 9A:
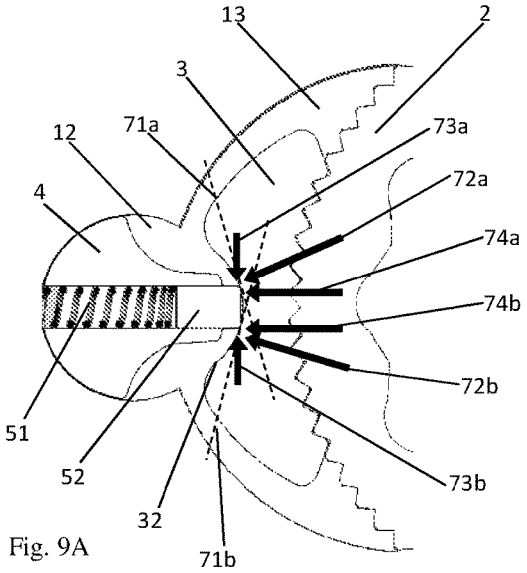
FIGS. 9A to 9C are a series of schematic views of the operation of the mechanism progressing towards a first stable position.
Figure 9B:
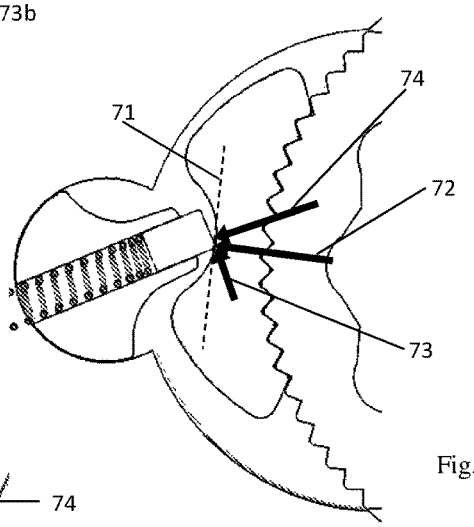
Figure 9C:
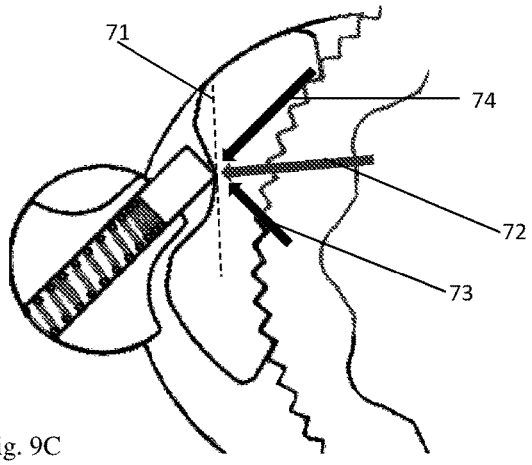

Consider now FIGS. 9A to 9C, in which the operation of the mechanism is shown in detail. Note that to clearly show the features of the operation of the mechanism, many of the common elements between FIGS. 9A, 9B and 9C have not been labelled again. In each of FIGS. 9A to 9C a close up of the interaction between the abutting block 52 and the indentation or recess 32 is shown as the device transitions from a neutral position to a driving position. FIG. 9A shows the mechanism in a neutral position, corresponding to a position of unstable equilibrium. In this arrangement, the switching member 4 is positioned within the second chamber 12 such that the abutting block 52 is urged through the hole 44 in the switching member 4 by the elastic member 51 to abut a central portion of the recess 32 in the rear (that is, the face opposite the second pawl portion 31) of the stopping member 3. In this arrangement, the stopping member 3 is in a central position, since it is approximately as far from a first internal wall of the third chamber 13 at the bottom of the figure as it is from an opposing, second, internal wall of the third chamber 13, at the top of the figure.

As shown, the abutting block 52 contacts the recess 32 in the rear of the stopping member 3 at two points. At a first point of contact, a first normal contact force 72*a* acts in a direction perpendicular to the tangent 71*a* to the curve of the recess 32 at the first point of contact. The normal reaction force 72*a* can be decomposed into component vectors in the x-direction 73*a* and the y-direction 74*a*. Similarly, at a second point of contact, a second normal contact force 72*b* acts in a direction perpendicular to the tangent 71*b* to the curve of the recess 32 at the second point of contact.

As used herein, a point of contact as it appears in the cross-sectional representation of FIGS. 9A to 11, may actually refer to a line of contact. This is best seen from the perspective view of FIG. 3, in which the abutting block 52 can be seen to have an edge along which contact will be made with recess 32. In other words, the vertices joining each pair of adjacent top and bottom front corners of the abutting block 52 each form a line along which contact may be made with the recess 32, a situation described in more detail below. Throughout the description, references to a point of contact should be interpreted as including a line of contact as described above.

Figure 3:
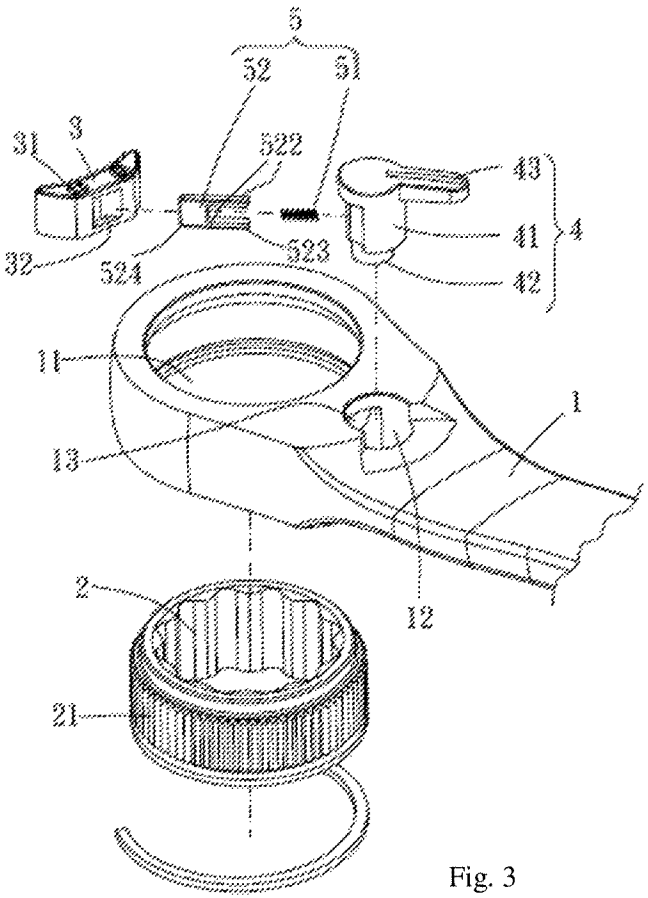
FIG. 3 is an exploded view of an embodiment of the present invention.
Figure 5:
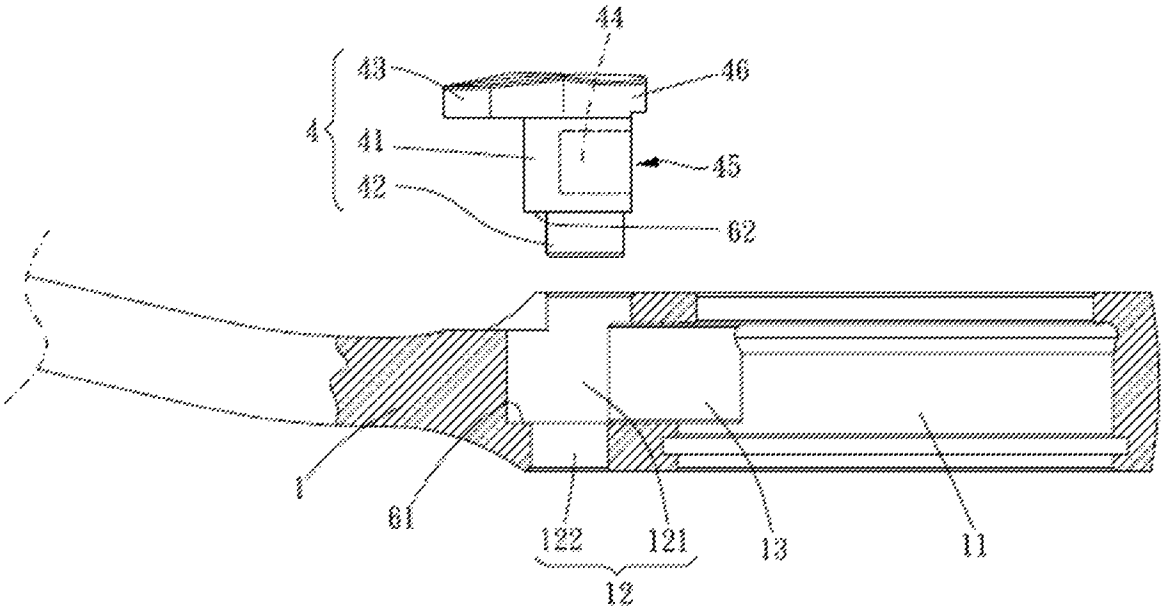
FIG. 5 and FIG. 6 are schematic views of the assembly of an embodiment of the present invention.
Figure 6:
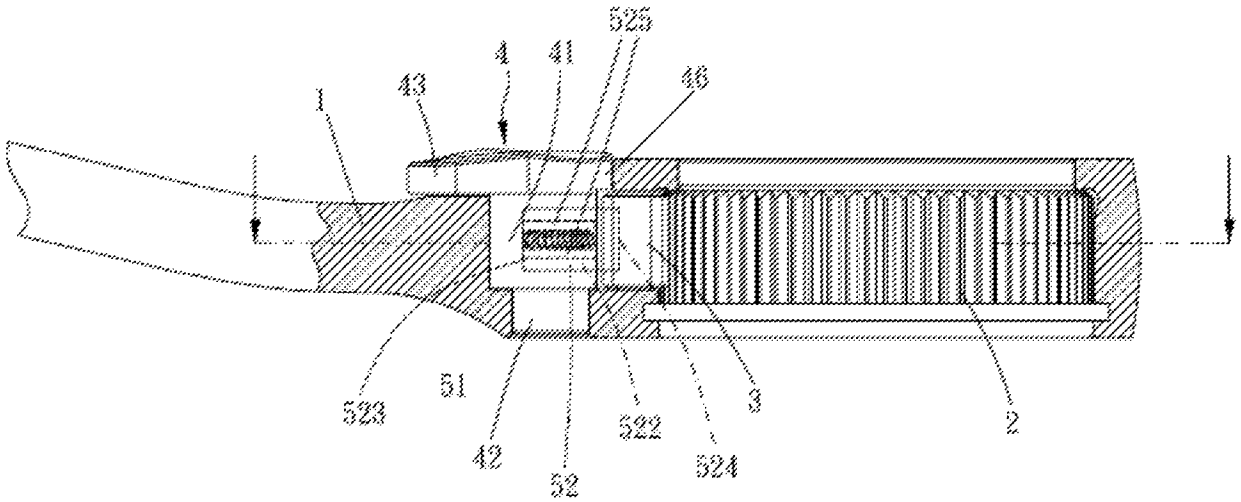

In some embodiments, the abutting block 52 also contacts the upper and lower flanges of the recess 32 which can be seen in FIG. 3. These flanges on the recess 32 can help to ensure that the abutting block 52 maintains contact with the recess, and does not slip in a vertical direction, and can also help ensure that the abutting block 52 does not twist.

The normal reaction force 72*b* can be decomposed into component vectors in the x-direction 73*b* and the y-direction 74*b*. In this discussion, the y-direction is the one opposing the pressing force provided by the elastic member 51, while the x-direction is perpendicular to this. Consequently, the y-direction component of the reaction forces 74*a* and 74*b* opposes the pressing force of the elastic member 51 (which here is a spring), and prevents the spring 51 from extending further and prevents the abutting block 52 sliding further in the hole 44 of the rotating member 41. In standard notation, the decomposition of the reaction force into components can be written:

$$F_x = F_{tot} \sin \varphi$$

$$F_y = F_{tot} \cos \varphi$$

Where $F_x$ and $F_y$ are respectively the magnitude of the component of the normal reaction force in the x- and y-directions, $F_{tot}$ is the magnitude of the total normal reaction force, and $\varphi$ is the angle between the direction of the force vector exerted by the elastic member 51 (which defines the y-direction) and the direction of the total normal reaction force 72 (i.e. perpendicular to the tangent to the curve of the recess at the point of contact).

The x-direction component of the two reaction forces operate in opposite directions. In the example shown in FIGS. 9A to 9C, the recess 32 is symmetrical in the central portion of the recess, so the component of each of the reaction forces in the x-direction are equal and opposite to one another. Consequently, the stopping member 3 remains in a position of equilibrium in the neutral position. In some embodiments, the recess 32 is not symmetric, but the neutral position is nonetheless maintained by frictional forces in the system. Note that in this neutral position, the driving member 2 is able to rotate in either direction relative to the body.

FIG. 9B shows a scenario in which the mechanism is offset from the neutral position. In particular, the stopping member 3 has moved towards an internal wall of the body 1. The transition from FIG. 9A to FIG. 9B may be achieved in various ways. For example, rotating the driving member 2 relative to the body can move the stopping member 3 towards an internal wall of the body 4 by virtue of the first pawl portion 31 and the second pawl portion 32 being engaged with one another. In other cases, rotating the switching member 4 in the second chamber 12 can drag the stopping member 3 via frictional contact between the abutting block 52 and the stopping member 3.

Whichever way the mechanism is made to transition from the equilibrium arrangement (FIG. 9A) to a non-equilibrium arrangement (FIG. 9B), it can be seen that the force diagram has changed. There is now only a single point of contact between the abutting block 52 and the recess 32. This results in the x-component 73 of the reaction force 72 being unbalanced, or in other words a net force in the x-direction on the abutting block 52. This net force further causes the abutting block 52 to rotate (bringing the switching member 4 with it). In addition, the frictional contact between the abutting block 52 and the stopping member 3 causes the stopping member 3 to be dragged still closer to the internal wall of the third chamber. Since the forces are unbalanced, this intermediate position (between the neutral position in FIG. 9A and the position shown in FIG. 9C) is not a position of equilibrium. That is to say, the arrangement shown in FIG. 9B is a snapshot of a transition; the mechanism will not remain statically in this arrangement.

Now consider FIG. 9C. Here, the movement of the stopping member 3 described in relation to the non-equilibrium arrangement of FIG. 9B has continued until the stopping member 3 has contacted an internal wall of the body. Once more the force diagram has changed to account for the slight change in the point of contact of the abutting block 51 on the recess 32. Note that the arrows 72, 73, 74 relate only to the reaction force (and its components) due to the recess 32 acting on the abutting block 52. Other forces, such as that exerted by the elastic member 51, or other reaction forces, are not shown. In particular, now that the stopping member 3 contacts the internal wall of the body, the internal wall exerts a reaction force on the stopping member. The mechanism is once more in an equilibrium position since the x-component 73 of the reaction force due to the contact between the abutting block 52 and the recess 32 is cancelled by the reaction force exerted be the internal wall on the stopping member. Similarly, the y-component 74 of the reaction force due to the contact between the abutting block 52 and the recess 32 is cancelled by the force exerted by the elastic member 51. Note also that at all points in the transition between the arrangements shown in FIGS. 9A and 9C (via the arrangement of FIG. 9B), the first and second pawl portions 31, 32 remain pressed into engagement with one another.

When the mechanism is in the arrangement shown in FIG. 9C, the driving member may rotate relative to the body in the anticlockwise direction. This is because, when the driving member is rotated anticlockwise, the rotation causes a force to be applied to the stopping member 3 (largely in the y-direction, e.g. $F_y$ 74), dragging it around the internal wall and compressing the elastic member 51. Note that while this is happening the force exerted by the abutting block 52 on the recess 32 helps to maintain the contact between the stopping member 3 and the internal wall, by virtue of the mechanism described above in detail. The stopping member therefore follows the internal wall, and continued rotation (in an anticlockwise direction) leads to the first and second pawl portions 21, 31 becoming less fully engaged with one another, because the stopping member 3 is not moving tangentially to the curved surface of the driving member 2. Consequently, once the driving member 2 has rotated sufficiently far, the first and second pawl portions momentarily disengage, causing the stopping member 3 to slide along the internal wall until the pawl portions reengage. Further anticlockwise rotations of the driving member repeat this process of the pawl portions 21, 31 gradually disengaging, slipping and reengaging.

Conversely, when the driving member 2 is rotated in the clockwise direction relative to the body, a force is applied to the stopping member largely in the x-direction, e.g. in the direction of $F_x$ 73. Since this is perpendicular to the y-axis, this is not able to move the stopping member by compressing the elastic member 51 (as e.g. an anticlockwise rotation can), but instead presses the stopping member 3 into the internal wall. Assuming that the rotational force is insufficient to deform or break the internal wall, there is no way to rotate the driving member clockwise relative to the body, when the mechanism is in the arrangement shown in FIG. 9C.

Put another way, the component force in the y-direction, $F_y$, 74 acts to implement the ratcheting function of the mechanism. At the same time, the component force in the x-direction, $F_x$, 73 acts to push the abutting block 52 away from the central, neutral position, and prevents the mechanism from being dragged back towards the central position. Without this unbalanced force arrangement, the act of rotating the driving member 2 would move the stopping member away from the internal walls of the body, thereby reducing the effectiveness of the mechanism, since torque can only be transferred from the body 1 to the driving member 2 when the stopping member 3 abuts an internal wall. Arrangements where the component force in the x-direction, $F_x$, 73 holds the stopping member 3 against an internal wall simplifies the design of the mechanism. Other ratchets make use of a detent (e.g. spring-loaded pin and groove, or similar) to hold the mechanism in a drive position. For example, a detent arrangement may be provided associated with the switching member 4, such that the rotation of the switching member 4 is impeded when the mechanism is in a drive position. This arrangement is significantly more complicated, and prone to breaking or failure due to misalignment, than the present system.

Turning these two examples around, the mechanism can be used to provide a one-way rotational ratchet assembly. When the driving member 2 is fitted around an object to be rotated, and the handle attached to the body (see e.g. FIG. 1) is rotated around the driving member 2 in a clockwise direction, this is equivalent to causing the driving member to rotate in an anticlockwise direction. As discussed above, this causes the pawls to slip relative to one another, and the handle (and body) can rotate relative to the driving member, so no torque is transferred to the object to be rotated. When the handle is rotated around the driving member 2 in the anticlockwise direction, this is equivalent to the driving member rotating in the clockwise direction relative to the body. In this case, as described above, the stopping member 3 wedges against the internal wall and locks the driving member 2 so that it does not rotate relative to the body. Consequently, torque is applied to the object to be rotated when the handle is turned in this direction.

Figure 10A:
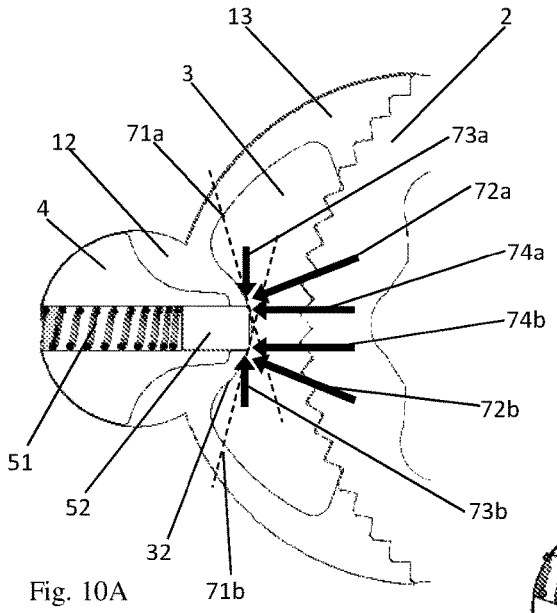
FIGS. 10A to 10C are a series of schematic views of the operation of the mechanism progressing towards a first stable position.
Figure 10B:
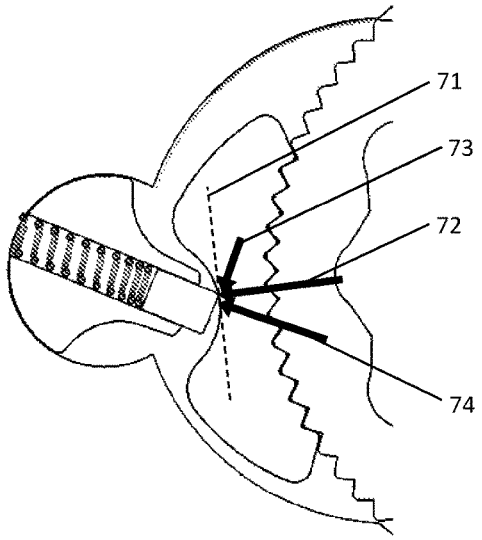
Figure 10C:
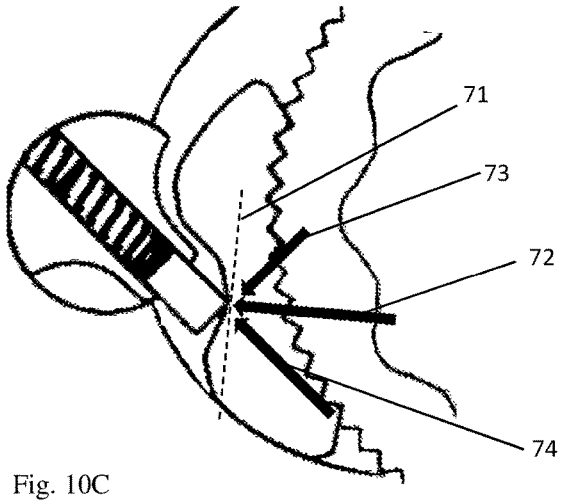

Consider now FIGS. 10A to 10C. These show a similar progression as that shown in FIGS. 9A to 9C. In this case, however, the mechanism is offset from the neutral position in the opposite direction as the figures progress; in FIGS. 9A to 9C, the stopping member 3 moves upwards and the switching member 4 rotates anticlockwise, while in FIGS. 10A to 10C, the stopping member 3 moves downwards and the switching member 4 rotates clockwise. Other than this change, it will be clear that the general operation of the mechanism is broadly the same. The action of an unbalanced x-component 73 of the normal reaction force 72 drives the stopping member into contact with an internal wall of the body (in FIGS. 9A to 9C this was the upper wall, while in FIGS. 10A to 10C this is a lower wall). Once in this contacting position, the driving member 2 is able to rotate in a clockwise direction relative to the body, but is blocked from rotating in an anticlockwise direction relative to the body, by virtue of the contact between the stopping member 3 and the internal wall.

Therefore, depending on whether the stopping member 3 contacts the upper or lower internal wall (see FIGS. 9C and 10C respectively), the mechanism can be used to select a direction in which torque can be supplied to an object to be rotated, while the opposite direction does not transfer torque to the object to be rotated.

Moreover, the arrangement of the mechanism as described is such that when the mechanism is offset in either direction from the neutral position of FIGS. 9A and 10A, the resultant forces drive the stopping member further, urging it towards, and eventually into contact with, the internal wall of the body in that direction.

Therefore, the position shown in FIGS. 9A and 10A is one of unstable equilibrium as, while the forces are balanced in that position, rotating offsetting the arrangement in either direction causes the component forces in the x-direction 73 to no longer balance. The ratchet mechanism therefore acts in a bistable manner, flipping very easily and with little offset into one or other driving direction.

Similarly, the two positions shown in FIGS. 9C and 10C are stable equilibria, since small offsets in the arrangement result in the mechanism being driven back to the position shown in these figures. Consequently, the mechanism has two stable positions of equilibrium (FIGS. 9C and 10C) and one unstable position of equilibrium (FIG. 9A or FIG. 10A), and can transition from the unstable position to either one of the unstable positions via non-equilibrium arrangements, exemplified by FIGS. 9B and 10B.

The mechanism can be reset to the neutral position by rotating the switching member 4. This causes the abutting block 52 to rotate as well, which drags the stopping member 3 around with it. In some embodiments, part of the switching member 4 may be configured to interfere with the stopping member 3 during this rotation, such that the interference directly pushes the stopping member 3 around. Such an interference interaction can also be used in some embodiments to assist in providing the offset by pushing the stopping member away from its central (neutral) position, rather than relying on friction between the abutting block 52 and the recess 32 alone. In general, the means for resetting the device are also suitable for generating the offset.

Figure 11:
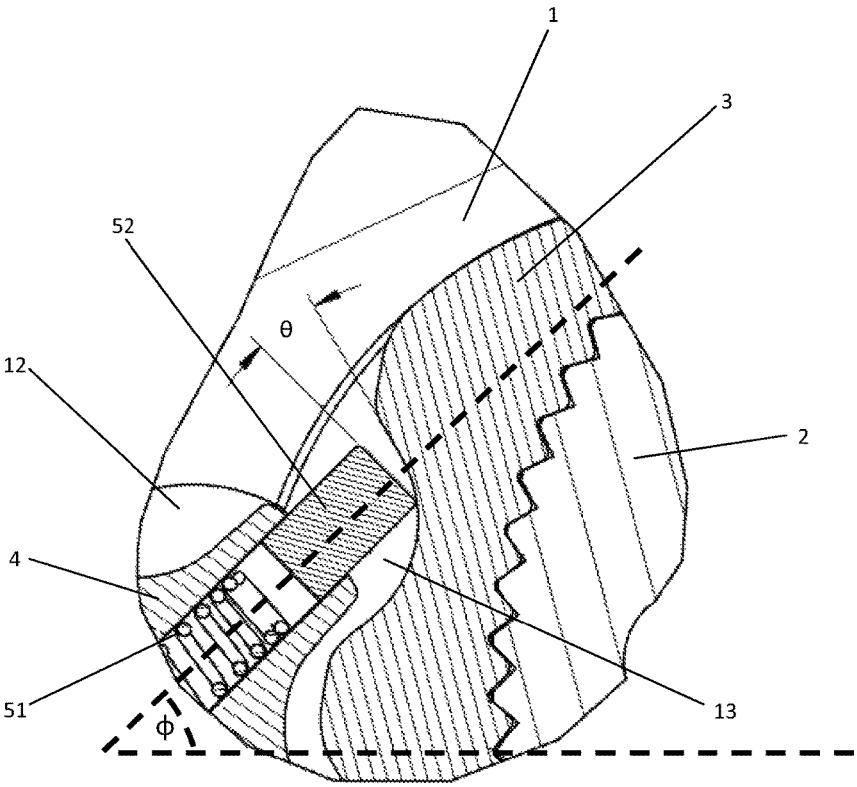
FIG. 11 is an enlarged view of the mechanism in a stable position.

Turning now to FIG. 11, a detailed view of the mechanism in one of the stable equilibrium positions is shown. Here it can be seen that there is an angular separation, θ, between the flat end of the abutting block 52 and the curve of the recess. This ensures that there is only a single point of contact between the abutting block and the recess, which in turn helps to ensure that positions intermediate to the equilibrium positions are themselves not equilibrium positions. Consequently, the angular separation helps to ensure that the mechanism switches quickly and easily between equilibrium positions. A typical value for θ may be 15° or so, but smaller separations are possible, for example 10° or even 5°.

Angular separations of this magnitude help to ensure that the abutting block 52 contacts the recess 32 a single point (or line). This in turn helps to ensure that the x-component of the reaction force 73 is unbalanced in the non-equilibrium and stable equilibrium configurations. This is helpful for retaining the stopping member 3 in a driving position (FIG. 9C or FIG. 10C).

In FIG. 11, it is apparent that the shape of the recess 32 plays an important role in the dynamics of the mechanism as it transitions between the neutral position and one of the stable equilibrium positions. As shown, the shape of the recess 32 is a section of a circle. This helps to ensure that the contact between the abutting block 52 and the recess 32 occurs at a single point during the transition of the mechanism between the various configurations. As set out above, the single point of contact is useful as it contributes to the imbalance of forces, which is characteristic of the non-equilibrium transition arrangements. Only a portion of a circular section is used, and it is clear that as distance from the centre of the recess 32 grows, the rear surface of the stopping member 3 (the surface opposite the second pawl portion 31) must curve outwards of the circular portion, in order to ensure that the angular clearance, θ, remains present throughout the transition. In addition, the abutting block 52 has relatively sharp corners for making contact with the recess 32. As set out in detail below, this assists in providing a point (or line) contact with the recess 32, and enhances the effect whereby unbalanced forces in the x-direction 73 drive the system to stable equilibrium positions, and further holds the system in that configuration.

Using this arrangement, the inventors have taken the following measurements relating the reaction force ($F_{tot}$) and its components ($F_x$, $F_y$) measured in grams (g) to the offset of the system:

| Lever Angle | $F_{tot}$ (g) | $F_x$ (g) | $F_y$ (g) | Notes |
|---|---|---|---|---|
| 0° | 452.6 | 0 | 452.6 | Neutral selected (unstable equilibrium) |
| +/−5.625° | 496 | 182 | 461.4 | Intermediate region |
| +/−11.25° | 511.6 | 224 | 459.9 | between forward/ |
| +/−16.8755° | 523.5 | 268 | 449.7 | reverse and neutral |
| +/−22.5° | 525.5 | 301 | 430.7 | (non-equilibrium) |
| +/−28.125° | 506 | 308 | 401.5 | |
| +/−33.75° | 463.7 | 295 | 357.7 | |
| +/−39.375° | 384.9 | 242 | 299.3 | |
| +/−45° | 272.4 | 162 | 219 | Forward/reverse selected (stable equilibrium) |

Here, the offset is parameterised by the lever angle, φ (see FIG. 11), taken to be the angle between the y-axis (aligned with the direction in which the elastic member 51 exerts a force) and the y-axis in a nominal neutral position, e.g. the y-axis as shown in FIGS. 9A and 10A. Consequently, FIGS. 9A and 10A show a lever angle of 0°. Similarly, selecting a forward or reverse drive position such as that shown in FIGS. 9C and 10C corresponds to a maximum lever angle. In the table above this maximum angle is 45°, although depending on the desired functionality, other angles could be used. Note that $F_{tot}$ first increases, then decreases with increasing lever angle. This is because the initial rotation of the switching member 4 causes the abutting block 52 to pivot about one of its points of contact and actually compresses the elastic member 51 at first (resulting in an increased force). Then, as the stopping member 3 moves closer to an internal wall of the body, the point of contact between the abutting block 52 and the recess 32 moves away from the switching member, so the elastic member 51 extends and causes the abutting block 52 to slide in the hole 44, while reducing the force exerted by the elastic member 51. This accounts for the reduction in $F_x$ at larger angles.

Of particular note in the above table is that the x-component of the reaction force jumps very quickly from zero to a substantial amount when the lever angle changes by only a few degrees in either direction. Adapting the shape of the recess 32 allows a different dependence of ($F_{tot}$, $F_x$, and $F_y$) on the lever angle, for example to allow even smaller lever angle offsets to take the mechanism out of the neutral arrangement, or to increase the range of lever angle positions at which the mechanism is retained in a neutral position.

The recess 32 may have only a circular profile, or it may have a circular portion flanked by linear regions. In some embodiments it can take yet more complex shapes, so long as it is generally concave. In many embodiments, the recess 32 is symmetric, but in some cases, the recess may be asymmetric. When the recess 32 is asymmetric, the neutral position may be maintained by frictional forces. A feature of asymmetric recesses is that the ease with which the mechanism settles into the two stable equilibrium positions may be different, thereby providing a "default" direction. Asymmetry near the centre of the recess makes it easier to initiate the transition in a particular direction, while asymmetry further from the centre of the recess affects the dynamics of the transition, i.e. how the forces vary with lever angle.

FIGS. 12A to 12C show some examples of shapes for the recess by showing the stopping member 3 alone and also in context in the mechanism (in each case in a position of stable equilibrium). In FIG. 12A, it is formed from three straight portions 321*a-c*. As shown in the figure, this can be arranged so that in a stable equilibrium position, a corner of the abutting block 52 is located in a corner between adjacent straight portions (e.g. 321*a* and 321*b*). In some embodiments, this does not happen, and the abutting block contacts only the central straight portion 321*b*. The separation between the abutting block 52 and the recess at all places, except the point of contact is ensured by arranging the straight portions 321*a* and 321*c* of the recess to be angled away from the end of the abutting block 52, when the mechanism is in the stable equilibrium position. In the example shown, the width of the abutting block 52 is approximately as wide as the central straight portion 321*b*. It is often preferable to make the width of the abutting block 52 wider than the central straight portion 321*b*, so that the abutting block contacts the recess 32 at two points (or lines) in the neutral position, rather than across an entire planar surface. This improves the stability of the neutral position.

FIG. 12B shows a second arrangement for the recess shape. A central concave curved portion 321*d* is flanked on either by straight portions 321*a*, 321*c*, which join the curved portion 321*d* tangentially. Once again, this arrangement allows there to be a clearance between the abutting block 52 and the recess, except at the point (or line of contact). As shown, the curved portion 321*d* is an arc forming part of a circle, although different curvatures are possible, for example parabolas, ellipses hyperbolae etc.

FIG. 12C shows a third arrangement for the recess 32, which here is a single concave curved portion 321*d*. The concave curved portion 321*d* transitions directly to convex curved portions which flank the central curved portion 321*d* to ensure that there is a clearance between the abutting block 52 and the recess 32 at all points except the point (or line) of contact when the mechanism is in a stable equilibrium position.

In each case the clearance provided by the shape of the recess ensures that there is only a single point (or line) of contact between the abutting block 52 and the recess 32, even when engineering tolerances are considered. Indeed, the recess shapes set out above are all suitable for use in the mechanism, as are variants and combinations of these. The principles for choosing a recess shape which is suitable for use in the mechanism are that:

There may be only a single point of contact between the abutting block 52 and the recess 32 at all positions, except the neutral position.

The x-component of the reaction force should remain unbalanced in the non-equilibrium and stable equilibrium positions. Put another way, the recess should never be shaped so that the tangent to the surface of the recess 32 at the point of contact is perpendicular to the direction of the biasing force provided by the elastic member.

Within these constraints, better recesses provide larger clearance. Other changes in shape affect the dynamics of the mechanism as it transitions towards stable equilibrium. For example, designs of recess can be provided which result in the unbalanced x-component force to have a particular form as the mechanism moves towards stable equilibrium. In particular, the unbalanced x-component force may be arranged to be substantially constant in the transition.

In addition, the point of contact is usually close to the centre line of the assembly. For example, the centre line is the horizontal line of symmetry in FIGS. 9A and 10A. In FIGS. 9A and 10A, the two contact points straddle this line of symmetry, each separated from the line of symmetry by half of the width of the abutting block 52. Taking as an example the progression shown in FIGS. 9A to 9C, the transition between FIGS. 9A and 9B clearly requires that the lower point of contact (the point initially at the part of the recess having line 71*b* as a tangent) moves closer to the centre line, and even crosses it. As the mechanism is driven further towards a stable position, this point of contact continues to move in the same direction, moving further from the centre line, towards an internal wall of the third chamber 13. Equivalent comments apply in respect of the transition shown in FIGS. 10A to 10C, in which the upper point of contact (the point initially at the part of the recess having line 71*a* as a tangent) moves closer to the centre line, and even crosses it. As the mechanism is driven further towards a stable position, this point of contact continues to move in the same direction, moving further from the centre line, towards an internal wall of the third chamber 13. In either case, this movement of the contact point may be due in part to the contact point moving along the recess, but the dominating (and in some cases the only) reason for this movement is the movement of the stopping member 3 itself such that the line of symmetry of the stopping member no longer aligns with the centre line of the mechanism (as it does in FIGS. 9A and 10A), but moves upwards or downwards, towards an internal wall.

In the cases described above, frictional forces may result in not just a single angle at which the neutral position exists but a range of lever angles. While the mechanism is configured to settle at one or other of the stable equilibrium positions, different implementations may provide different critical angles beyond which the mechanism drives itself into the stable equilibrium positions. For example, a lever angle of 10°, 5°, 2° or even only 1° off centre may be sufficient to cause the mechanism to transition all the way to a stable equilibrium position.

Although the neutral position shown in FIGS. 9A and 10A has two points of contact between the abutting block 52 and the recess 32, in some embodiments only a single point of contact may exist at all lever angles. The flat end of the abutting block causes the two contact points by providing two corners. However, a rounded or pointed end to the abutting block would result in a single point of contact. Such an arrangement has the effect of making the unstable equilibrium position even more unstable, and thereby narrows the range of lever angles at which the mechanism is in the neutral position. In other words, this enhances the ease with which the mechanism transitions into the stable equilibrium positions.

In some embodiments, the point of contact between the abutting block 52 and the recess 32 remains substantially fixed during the transition, while in other embodiments, the point of contact moves.

In summary, in the ratchet wrench of the present invention, the mechanism is configured to have a single position of unstable equilibrium (defined by a particular angle or angular range of the lever angle) and two positions of stable equilibrium. Once the mechanism is altered so that it is no longer in the unstable equilibrium position, the resultant forces drive the mechanism towards one of the stable equilibrium positions in which torque in a selected direction can be transferred from the body to the driving member. The angular range of the unstable equilibrium position is determined in part by the shape of a recess 32 in the rear surface of the stopping member. In particular, this arrangement allows small initial offsets (e.g. changing the lever angle by rotating the switching member 4) to nonetheless drive the mechanism to a stable, driving position in which torque is transferable in a selected direction from the body to the driving member. Since the driving member 2 and the stopping member 3 are engaged with one another by pawl portions 21 and 31, the system can even be off-centred by a small rotation of the driving member, allowing a very quick and easy selection of driving direction.

Figure 13A:
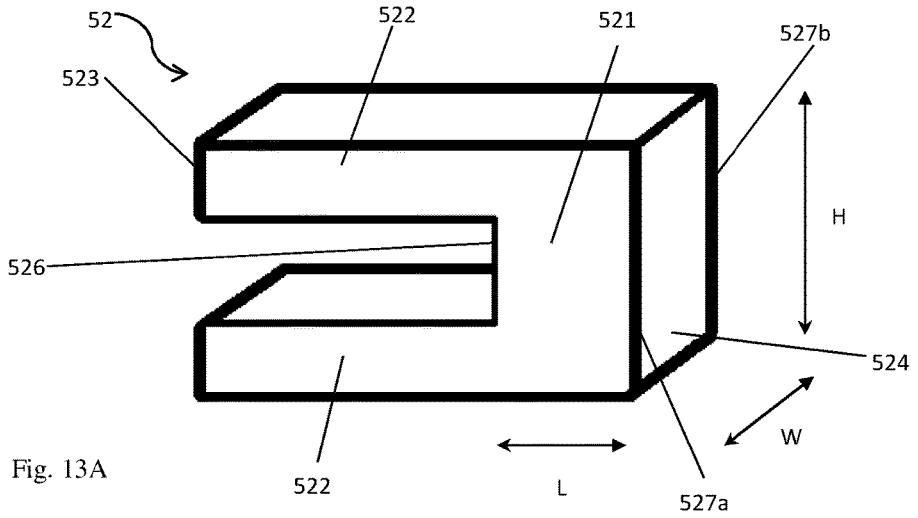
FIGS. 13A to 13C show perspective views of variants of the abutting block.
Figure 13B:
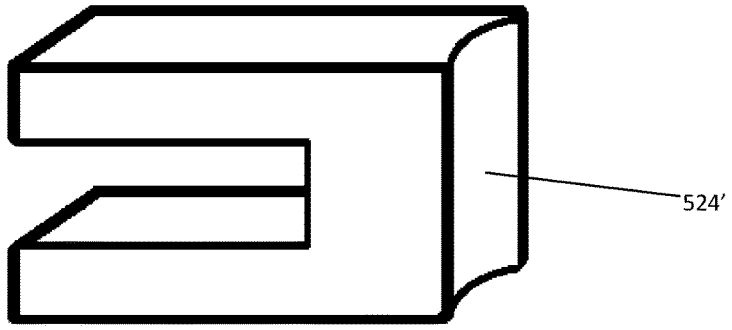
Figure 13C:
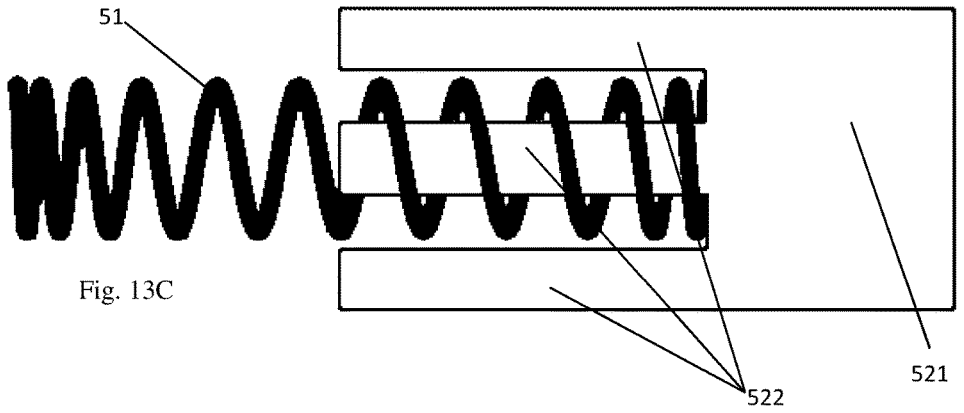

Consider now FIGS. 13A to 13C, which show the abutting block 52 in detail. The abutting block 52 comprises a generally cuboidal body 521 having length (L), width (W) and height (H) and comprising a first face 524 and a second face 526 opposite the first face 524, separated from one another by the length of the body 521. That is, the first and second face 524, 526 are separated from one another by a distance L. The first face 524 is adapted for engaging with a stopping member (not shown) as set out below in detail. In particular, however, the first face 524 has a pair of opposed straight edges 527*a*, 527*b* (referred to herein generally as 527) extending along the height direction for engaging the stopping member. The second face is adapted to engage with an elastic member 51 as set out below.

The straight edges 527 are configured to provide a single line of contact which, as set out above in detail, helps to ensure that the non-equilibrium positions of the assembly result in the system being driven towards an arrangement of stable equilibrium. Similarly, the single line of contact helps to stably maintain the mechanism in the stable equilibrium (driving) arrangement. Each of these effects results from the unbalanced x-component of the reaction force. A pair of opposed straight edges 527 not only provides these benefits when the system is offset in either rotational direction (i.e. towards both the clockwise and anti-clockwise driving directions), but also provides two lines of contact in the neutral position. As set out above, the provision of two lines of contact in the neutral position allows the x-components of the reaction forces to cancel one another, thereby providing a position of (unstable) equilibrium.

In order to help provide a straight, or linear, edge a sharp angle may be provided at the edges 527. For example, the sides of the abutting block 52 which extend in the length and height directions may meet the first face 524 at an angle which is no greater than 90°. In some cases, engineering tolerances may cause rounding close to the edges. In this case, the angle referred to above is the angle that the plane of each of the faces which meet at edge 527 would make if extended to meet one another without curving.

In some cases, the first face 524 is planar, which simplifies the above analysis. In other cases, see for example FIG. 13B, the first face 524' may be concave to provide a sharper angle at the edges 527. Although a curved concave surface is shown in FIG. 13B, any form of surface indentation may be used, e.g. a series of straight portions. In the event of a concave surface 524', the angle at the edge 527 referred to above means the angle between a plane tangent to the portion of the concave surface closest to the edge 527 and the sides of the abutting block 52. In the event that the sides of the abutting block 52 are themselves non-planar (by design or otherwise), similar considerations apply to determine the angle at the edges 527.

A benefit of concave designs is to improve the separation between the abutting block 52 and the recess 32. Consider the situation shown in e.g. FIGS. 12A to 12C. The gap between the abutting block 52 and the recess 32 tapers, gradually increasing from zero (i.e. contact) at the point (or line) of contact to a maximum value at the opposite edge of the abutting block. In the event that manufacturing inaccuracies affect the shape of the abutting block or the recess, it is possible that a second point (or line) of contact may occur, thus hampering the operation of the mechanism. By manufacturing the abutting block 52 with a concave face, the portions of the first face 524 which would otherwise be closest to the recess 32 (and thus most likely to accidentally touch due to manufacturing inaccuracies) are moved away from the recess 32.

In some cases, a sharper angle at the edges 527 can be achieved by arranging the body 521 to taper, for example so that the first face 524 is wider than the second face 526. Such an arrangement requires the switching member 4 to be adapted, so that the hole 44 is able to receive the abutting block 52. A tapering abutting block 52 allows a wide first face 524 as well as providing a sharp edge 527, both of which improve the operation of the mechanism.

In each of the examples shown in FIGS. 13A to 13C, the abutting block 52 further comprise first and second arms 522 extending from the second face 526 in the length direction. These arms are configured to fit into the hole 44 in the switching member 4. By extending the abutting block 52 in this way, the portions which slide in the hole 44 are behind the point at which the elastic member 51 contacts the second face 526. This means that the entire body 521 including the point of contact between the elastic member 51 and the abutting block 52 can even exit the hole 44 without affecting the stability of the abutting block 52 when it is seated in the hole 44 because the far end of the arms 523 remains in the hole 44. The abutting block is usually generally slightly narrower than the hole 44 in the switching member. Moreover, the abutting block 52 is wider than the elastic member 52 in a preferred embodiment. This allows the abutting block 52 to extend across all substantially all of the width of the hole 44, which can help to prevent the abutting block 52 from twisting in the hole 44. The spacing between the outer pair of arms 522 is at least as large as, and in some embodiments is larger than, the height of the elastic member 51. For completeness, this means that when the elastic member 51 has a height equal to its width (e.g. if it is a cylindrical spring), the height of the spacing between the arms 522 is approximately equal to the width of the abutting block 52.

The elastic member abuts the second face 526 at a point other than that from which the arms 522 extend. The engagement may be by providing an indentation into which an end of the elastic member 51 is insertable. Alternatively, a protrusion may be provided, with which the elastic member 51 engages or attaches. In some cases, this protrusion may be a third arm extending from the second face 526 in the length direction, for retaining the elastic member 51, as shown in FIG. 13C. This arrangement makes use of a hollow elastic member 51, such as a compression spring. The hollow elastic member 51 slots over the third leg 522. This arrangement provides additional support against the elastic member 51 buckling when it is compressed. As shown, the first, second and third arms 522 are the same length as one another, although this is not strictly necessary.

The figures show the first and second arms 522 spaced apart from one another in the height direction such that the spacing between the first and second arms 522 is larger than extent of either of the first or second arm 522 in the height direction. This provides a sufficient clearance for the elastic member 51 to be retained between the legs 522.

As shown in FIGS. 13A to 13C, the body 521 has a top surface and a bottom surface, each extending in the width and the length directions, and separated from one another in the height direction, wherein the first arm 522 is an upper arm aligned with the top surface of the body 521 and the second arm 522 is a lower arm aligned with the bottom surface of the body 521. This means that the abutting block can slide smoothly into and out of the hole 44. The upper and lower arms 522 and prevent the elastic member 51 from buckling under compression in the height direction. The internal walls of the hole 44 prevent buckling in the width direction, when the elastic member 51 is compressed.

The first and second arms 522 extend in the length direction at least 1.5 times as far as the length (L) of the body 521. In some examples, the arms 522 are twice as long as the body 521. This provides stability because the arms can be retained in the hole 44, even when the abutting block moves relatively large distances.

The abutting block 52 may have a height of the first face 524 which is at least 150% of the width of the first face 524. In general a wider first face 524 is preferable, as this increases the separation between the first face 524 and the recess 32, thereby reducing the likelihood of the first face 524 contacting the recess 32 at more than one point (or line). The maximum width of the face is determined by other constraints, such as the size of the mechanism, and the precise details of the switching member 4. Moreover, the mechanism can be returned to the neutral position by simply rotating the switching member 4 (e.g. using dial member 43), which causes the stopping member to be dragged back towards the neutral position, so that a different driving direction can be selected.

A known ratchet wrench, such as that described in the patent numbered TWM520964, is primarily a wrench body provided with a drive ratchet wheel, a ratchet block and a knob, where the knob is rotatably disposed on the body. A spring is provided between the knob and the ratchet block to normally abut the ratchet block toward the drive ratchet wheel so as to limit the direction of rotation of the drive ratchet wheel.

However, the knob of the conventional ratchet wrench is flipped upside down when turned, which gives rise to a jerky sensation, and in serious cases may cause the knob to jump off the wrench body, scattering the spring, knob and ratchet block and necessitating their reassembly, thus affecting the progress of work, and this is a shortcoming in need of improvement.

In accordance with the above description, the ratchet mechanism described herein also provides a novel and improved ratchet wrench to solve the above-mentioned problem.

This occurs because the mechanism described herein provides a ratchet wrench comprising a body, a driving member, a stopping member, a switching member and an elastic abutting assembly. The body is provided with a first chamber, a second chamber parallel to the first chamber, and a third chamber that communicates with the first chamber and the second chamber, one of the two ends of the second chamber being formed with a large diameter section, and the other end being formed with a small diameter section. The driving member is rotatably provided in the first chamber and is provided with a first pawl portion along the outer peripheral surface. The stopping member is provided in the third chamber and is provided with a second pawl portion which is engaged with the first pawl portion, and the second pawl portion limits the direction of rotation of the driving member. The switching member is rotatably provided in the second chamber and comprises a rotating member and a protrusion extending from the rotating member, the rotating member being accommodated in the large diameter section, and the protrusion being accommodated in the small diameter section. The rotating member is radially provided with a dial member for manipulation on the end remote from the protrusion, and is further radially provided with a hole. The elastic abutting assembly comprises an elastic member and an abutting block, which comprises a first end and a second end, the first end comprising two stop arms, said two stop arms extending to the second end. The elastic member is positioned between the two stop arms and forms a gap between both stop arms. The first end and the elastic member are received in the hole, and the elastic member is elastically urged between the second end of the abutting block and the switching member such that the second end of the abutting block normally abuts the stopping member against the first pawl portion. Wherein, the direction of rotation of the driving member may be adjusted by adjusting the switching member to switch the position at which the stopping member engages with the first pawl portion.

In this example, the abutting block is U-shaped, and the thickness thereof can be made more uniform during the fabrication process. Since the elastic member is located between the two stop arms and forms gaps 525 with both stop arms, the elastic member does not come into contact with the stop arms during elastic extension and contraction, such that the elastic member can be smoothly extended and retracted to prevent buckling of the elastic member during extension and contraction attenuating the elastic force of the elastic member. Further, since the elastic member is not brought into contact with the two stop arms, the outer diameter of the elastic member may be slightly increased to provide a more stable spring force to urge against the abutting block and enable better engagement between the first pawl portion and the second pawl portion, avoiding damage resulting from reverse rotation of the switching member.

Additionally, in some cases, a first step is formed between the large diameter section and the small diameter section, and a second step is formed between the rotating member and the protrusion, the first step and the second step abutting against each other in order to assist in stably positioning the rotating member in the large diameter section.

Respective features of the illustrated embodiments may be combined in a different combinations as required by particular circumstances or preferences so as to provide the functionality of a tool with a ratchet mechanism.

It should be understood, therefore, that the invention is not limited to the specific embodiments disclosed herein, and that modifications and other embodiments of the invention are intended to be included within the scope of the invention. Those skilled in the art should now appreciate that various adaptations and modifications of the example and alternative embodiments described above can be configured without departing from the scope and spirit of the invention. Therefore, it is to be understood that, within the scope of the appended claims, the invention may be practiced other than as specifically described herein.

What is claimed is:

1. A tool with a bistable ratchet mechanism, comprising:

a body (1) having a first chamber (11), a second chamber (12) adjacent to the first chamber (11) and a third chamber (13) connecting the first and second chambers to one another;

a driving member (2), being rotatably retained in the first chamber (11), and having a first pawl portion (21) arranged around an external portion of the driving member (2);

a stopping member (3), provided in the third chamber and having a second pawl portion (31) arranged on a first face, and arranged so that the second pawl portion (31) engages with the first pawl portion (21), the stopping member (3) further having a recess (32) in a second face of the stopping member (3), opposite the second pawl portion (31);

a switching member (4), rotatably provided in the second chamber and comprising a rotating member (41), the rotating member being radially provided a hole (44) the rotating member (41) being further radially provided with a dial member (43) for manipulating the rotating member (41); and an elastic abutting assembly (5), comprising an elastic member (51) and an abutting block (52), the elastic member (51) in contact with a first end of the abutting block, the first end of the abutting block (52) and the elastic member (51) being received in the hole (44), and the elastic member (51) biasing the abutting block (52) toward the a recess (32) the stopping member (3), to bias the stopping member (3) into contact with the driving member (2); wherein the mechanism is configurable in a position of unstable equilibrium, a first position of stable equilibrium or a second position of equilibrium, and is configured to transition between the stable and unstable equilibrium positions via non-equilibrium positions by rotating the switching member (4); wherein:

the position of unstable equilibrium corresponds to a neutral position in which the driving (2) member is rotatable in two directions relative to the body (1);

in the first stable equilibrium position the stopping member (3) contacts a first internal wall of the body (1) and prevents the driving member (2) from rotating in a first direction relative to the body (1); and in the second stable equilibrium position the stopping member (3) contacts a second internal wall of the body (1) and prevents the driving member (2) from rotating in a second direction relative to the body (1), the second direction being opposite to the first direction; and wherein positions between the stable and unstable equilibria are non-equilibrium positions because a force biasing the abutting block (52) is incompletely cancelled by the reaction force (71) acting on the abutting block (52) from the stopping member (3), the resultant force further biasing the stopping (3) member towards an internal wall of the body (1).

2. The tool with a ratchet mechanism of claim 1, wherein rotating the driving member (2) when the stopping member (3) is in the position of unstable equilibrium causes the stopping member (3) to move towards a position of stable equilibrium via a non-equilibrium arrangement.

3. The tool with a ratchet mechanism of claim 1, wherein the elastic member (51) is a compression spring.

4. The tool with a ratchet mechanism of claim 1, wherein rotation of the switching member (4) changes the location at which the abutting block (52) contacts the stopping member (3).

5. The tool with a ratchet mechanism of claim 1, wherein the mechanism is transitionable from the position of unstable equilibrium to a non-equilibrium position by:

(a) rotating the switching member (4) and dragging the stopping member (3) via a frictional interaction between the abutting block (52) and the recess (32);

(b) pushing the stopping member (3) with a portion of the switching member (4), when the switching member (4) is rotated; and/or (c) rotating the driving member (2) relative to the body (1).

6. The tool with a ratchet mechanism of claim 5, wherein the transition from the position of unstable equilibrium to a position of stable equilibrium is facilitated by the shape of the recess (32).

7. The tool with a ratchet mechanism of claim 5, wherein a transition from the position of unstable equilibrium to a non-equilibrium position occurs at a critical angle of rotation of the switching member (4).

8. The tool with a ratchet mechanism of claim 1, wherein the stopping member (3) is moveable from a position of stable equilibrium to the position of unstable equilibrium by:

(a) rotating the switching member (4) and dragging the stopping member (3) via a frictional interaction between the abutting block (52) and the recess (32); and/or (b) pushing the stopping member (3) with a portion of the switching member (4), when the switching member (4) is rotated.

9. The tool with a ratchet mechanism of claim 1, wherein the transition from the position of unstable equilibrium to a position of stable equilibrium is facilitated by the shape of the recess (32).

10. The tool with a ratchet mechanism of claim 9, wherein the recess (32) comprises a circular section.

11. The tool with a ratchet mechanism of claim 10, wherein the recess (32) further comprises linear portions.

12. The tool with a ratchet mechanism of claim 1, wherein the abutting block (52) contacts the recess (32) along a single point or line in all positions of the stopping member (3).

13. The tool with a ratchet mechanism of claim 1, wherein the abutting block (52) contacts the recess (32) along a single point or line in all stopping member (3) positions except for the position of unstable equilibrium.

14. The tool with a ratchet mechanism of claim 13, wherein there are two points or lines of contact between the abutting block (52) and the recess (32) when the stopping member (3) is in the unstable equilibrium position.

15. The tool with a ratchet mechanism of claim 14, wherein the recess (32) is symmetric about a central portion of the recess (32).

16. The tool with a ratchet mechanism of claim 13, wherein the recess (32) is symmetric about a central portion of the recess (32).

17. The tool with a ratchet mechanism of claim 1, wherein a transition from the position of unstable equilibrium to a non-equilibrium position occurs at a critical angle of rotation of the switching member (4).

18. The tool with a ratchet mechanism of claim 1, wherein the position of unstable equilibrium corresponds to a range of rotational orientations of the switching member.

* * * * *